US006298558B1

(12) United States Patent
Tseng et al.

(10) Patent No.: US 6,298,558 B1
(45) **Date of Patent: *Oct. 9, 2001**

(54) SKIN ENGAGING MEMBER

(75) Inventors: Mingchih Michael Tseng, Hingham; Yuling Yin, Quincy; Frank E. Badin, Scituate, all of MA (US); Thilivali T. Ndou, Gaithersburg, MD (US); Brian A. Rogers, South Boston, MA (US); Lee K. Lim, Bethesda, MD (US)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/497,194

(22) Filed: Jun. 30, 1995

Related U.S. Application Data

(63) Continuation-in-part of application No. 08/332,293, filed on Oct. 31, 1994, now abandoned.

(51) Int. Cl.[7] ..... B26B 21/44

(52) U.S. Cl. ..... 30/41; 30/50

(58) Field of Search ..... 30/41, 41.7, 41.5, 30/40.2, 345, 90, 50, 84, 537, 538; 424/73; 132/289, 290, 292

(56) References Cited

U.S. PATENT DOCUMENTS

| | | | | |
|---|---|---|---|---|
| 1,292,982 | * | 1/1919 | Wolf | 132/290 X |
| 1,497,647 | | 6/1924 | Smith | 30/34.2 |
| 1,565,680 | | 12/1925 | Silverwood | 30/34.2 |
| 2,004,087 | | 6/1935 | Testi . | |
| 2,040,345 | | 5/1936 | Taylor | 30/34.2 |
| 2,068,085 | | 1/1937 | Stanley . | |
| 2,098,036 | | 11/1937 | Gore | 30/34.2 |
| 2,548,959 | | 4/1951 | Eisenberg et al. . | |

(List continued on next page.)

FOREIGN PATENT DOCUMENTS

| | | |
|---|---|---|
| 0 254 491 | 1/1988 | (EP) . |
| 348627 | 1/1990 | (EP) . |
| 2 323 502 | 4/1977 | (FR) . |
| 259 268 | 10/1926 | (GB) . |
| 1 557 177 | 12/1979 | (GB) . |
| 2024082 | 1/1980 | (GB) . |
| 1 444 545 | 8/1976 | (GN) . |
| WO 90/05047 | 5/1990 | (WO) . |
| 96/04112 | 2/1996 | (WO) . |

OTHER PUBLICATIONS

Levy, *Plastics Extrusion Technology Handbook,* Industrial Press Inc. (1981).*

*Primary Examiner*—Clark F. Dexter
(74) *Attorney, Agent, or Firm*—Stephan P. Williams

(57) ABSTRACT

This relates to an improved skin engaging member for use in razor blade; cartridge assemblies and shaving systems of the wet shave type. In an embodiment, there is provided a two-component, control-release shaving device consisting of(a) a sheath layer made from thermoplastic resins with openings therein and (b) a core region containing internal shaving aids. Potentially, the device can maintain surface appearance, control-release the shaving aids, minimize the degradation of the shaving aids, and prevent the shaving aids from being trapping in a strip. Furthermore, the addition of low-melt additives to the shaving aids becomes feasible and the compatibility between the shaving aids and the shaving aid carrier such as polystyrene in the lubricating strip composite becomes less critical.

14 Claims, 5 Drawing Sheets

U.S. PATENT DOCUMENTS

| | | | | |
|---|---|---|---|---|
| 2,568,047 | | 9/1951 | Anderson | 30/34.2 |
| 2,600,880 | | 6/1952 | Karle | 30/34.2 |
| 2,814,104 | | 11/1957 | Miller | 30/34.2 |
| 3,138,865 | | 6/1964 | Meyer | 30/34 |
| 3,486,225 | | 12/1969 | Regan | 30/41 |
| 3,722,090 | | 3/1973 | Dawidowicz | 30/32 |
| 3,895,437 | | 7/1975 | DiBuomo | 30/90 |
| 3,909,939 | | 10/1975 | Dootson | 30/34.2 |
| 3,939,560 | | 2/1976 | Lyall | 30/34.2 |
| 3,969,817 | | 7/1976 | DiBuono | 30/41 |
| 4,170,821 | | 10/1979 | Booth | 30/41 |
| 4,189,832 | | 2/1980 | Harper et al. | 30/34.2 |
| 4,211,006 | | 7/1980 | Halaby et al. | 30/346.55 |
| 4,310,968 | | 1/1982 | Buik et al. | 30/34.2 |
| 4,314,404 | | 2/1982 | Rruiz et al. | 30/41 |
| 4,318,900 | * | 3/1982 | Rowsell et al. | 424/73 |
| 4,344,930 | | 8/1982 | MacRae et al. | 424/28 |
| 4,381,293 | | 4/1983 | Michel et al. | 424/14 |
| 4,501,834 | | 2/1985 | Su | 524/28 |
| 4,535,537 | | 8/1985 | Ferraro et al. | 30/32 |
| 4,548,810 | | 10/1985 | Zofchak | 424/59 |
| 4,586,255 | | 5/1986 | Jacobson | 30/41 |
| 4,624,051 | | 11/1986 | Apprille et al. | 30/50 |
| 4,690,825 | * | 9/1987 | Won | 424/501 |
| 4,697,342 | | 10/1987 | Ferraro | 30/41 |
| 4,741,103 | | 5/1988 | Hultman | 30/34 |
| 4,777,722 | | 10/1988 | Trotta | 30/84 |
| 4,813,131 | | 3/1989 | Gruner | 30/50 |
| 4,831,731 | | 5/1989 | Eltis | 30/50 |
| 4,850,106 | * | 7/1989 | Braun et al. | 30/41 |
| 4,858,314 | | 8/1989 | Cunningham | 30/90 |
| 4,866,844 | | 9/1989 | Burout | 30/50 |
| 4,872,263 | | 10/1989 | Etheredge | 30/41 |
| 4,875,287 | | 10/1989 | Creasy et al. | 30/34.01 |
| 4,944,090 | * | 7/1990 | Sumnall | 30/41 |
| 4,954,337 | | 9/1990 | Gripp et al. | 424/73 |
| 4,997,656 | * | 3/1991 | Shikinami et al. | 424/448 |
| 5,001,832 | | 3/1991 | Althaus et al. | 30/77 |
| 5,010,646 | | 4/1991 | Neamtu | 30/50 |
| 5,043,326 | * | 8/1991 | Stadler nee Szoke et al. | 514/58 |
| 5,056,222 | | 10/1991 | Miller | 30/77 |
| 5,063,667 | | 11/1991 | Jacobson | 30/41 |
| 5,067,238 | | 11/1991 | Miller et al. | 30/34.002 |
| 5,079,839 | | 1/1992 | Conrad et al. | 30/41 |
| 5,095,619 | | 3/1992 | Davis | 30/41 |
| 5,113,585 | | 5/1992 | Rogers et al. | 30/41 |
| 5,134,775 | * | 8/1992 | Althaus et al. | 30/41 |
| 5,249,361 | * | 10/1993 | Apprille, Jr. et al. | 30/50 X |
| 5,340,581 | | 8/1994 | Tseng et al. | 424/401 |
| 5,345,680 | * | 9/1994 | Vreeland et al. | 424/73 |
| 5,349,750 | * | 9/1994 | Tseng | 30/41 |
| 5,369,885 | * | 12/1994 | Ferraro | 30/41 |
| 5,454,164 | * | 10/1995 | Yin et al. | 30/41 |
| 5,493,778 | * | 2/1996 | Ichiyanagi | 30/50 X |
| 5,524,347 | * | 6/1996 | Prochaska | 30/50 |
| 5,555,152 | * | 9/1996 | Tseng | 30/41 |

* cited by examiner

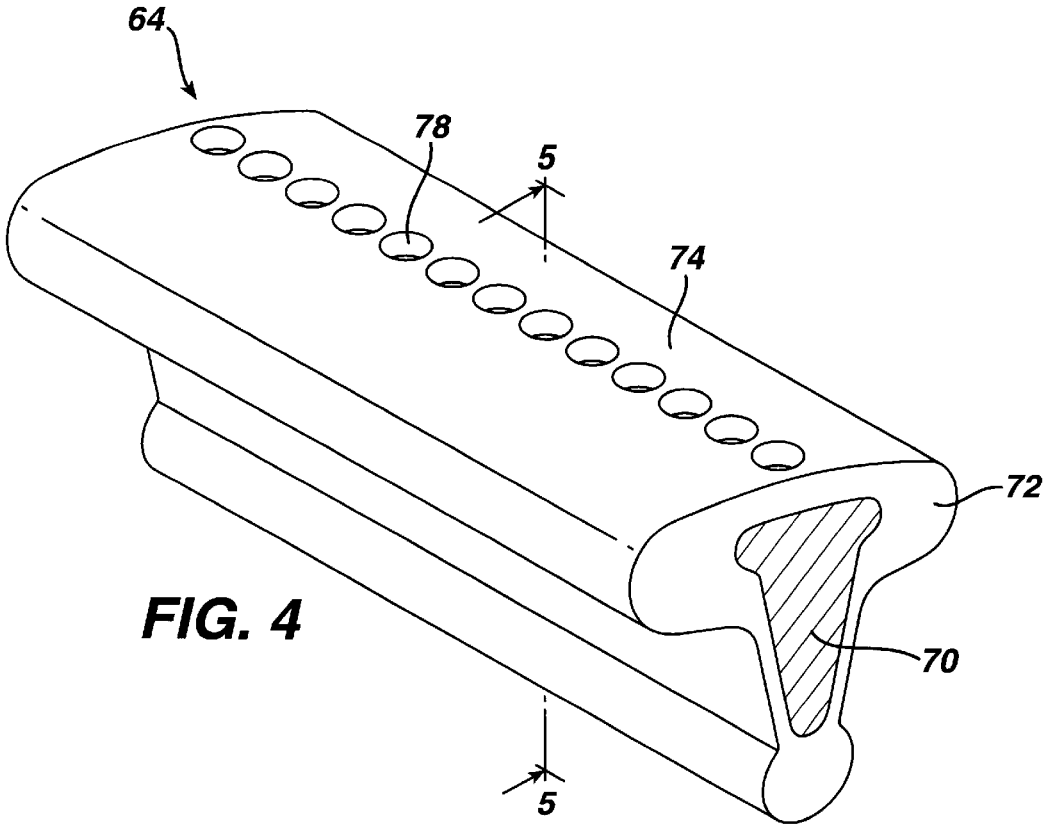
FIG. 4
FIG. 5
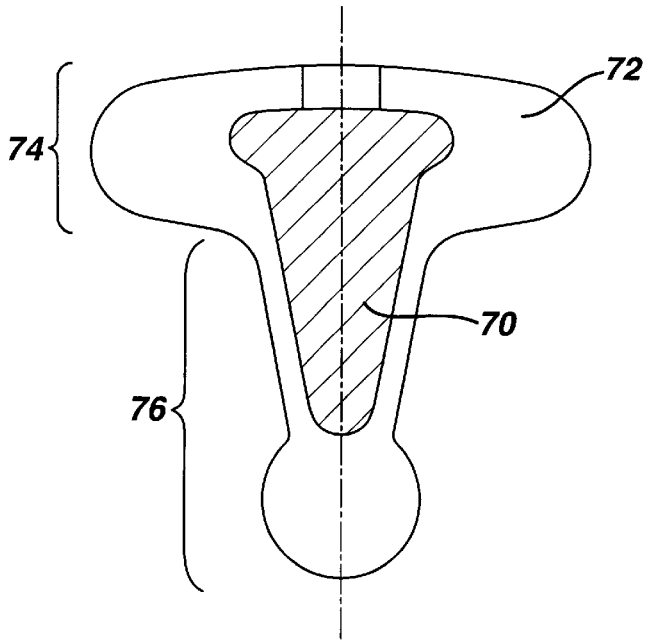

SKIN ENGAGING MEMBER

RELATED APPLICATIONS

This application is a continuation-in-part of U.S. Ser. No. 08/332,293 filed Oct. 31, 1994 now abandoned.

BACKGROUND OF THE INVENTION

1. Field of the Invention

This invention relates to an improved skin engaging member for use in razor blade cartridge assemblies and shaving systems of the wet shave type. The present invention resides broadly in providing the skin engaging cap and/or guard surfaces with configurations which deliver a shaving aid as the razor is dragged across the skin. Suitable shaving aids include lubricants, whisker softeners, razor cleaners, medicinal agents, cosmetic agents or combinations thereof. This invention also relates to a novel method of manufacturing the skin engaging member of the present invention.

2. Description of the Prior Art

In shaving systems of the wet shave type, factors such as the frictional drag of the razor across the skin, the force needed to sever hairs, and irritation of pre-existing skin damage can create a degree of shaving discomfort. Discomfort, and other problems accompanying wet shaving systems, can be alleviated by the application of shaving aids to the skin. Shaving aids may be applied prior to, during, or after shaving. A number of problems accompany the use of pre- and post-applied shaving aids. Pre-applied-shaving aids can evaporate or can be carried away from the site of application by repeated strokes of the razor. Post-applied-shaving aids are not present on the skin during shaving and thus their application may be too late to prevent an unwanted affect. Both pre-applied and post-applied shaving aids add additional steps to the shaving process.

Proposals have been made to incorporate a shaving aid, e.g. lubricant, whisker softener, razor cleanser, medicinal agent, cosmetic agent or combination thereof, into a razor, e.g. by depositing a shaving aid in a recess on the razor, by incorporating a shaving aid directly into one or more molded polymeric components of the razor, by adhesively securing a shaving aid composite to the razor, and by use of a mechanical connection between a shaving aid composite and the razor. A water-soluble shaving aid, e.g. polyethylene oxide, has been mixed with water insoluble matrix material, e.g., a polystyrene polymer, to form an insoluble polymer/soluble shaving aid composite as in U.S. Pat. No. 4,170,821 to Booth and U.S. Pat. No. 5,113,585 to Rogers. The composite has been mounted on razor and shaving cartridge structures, adjacent the shaving edge or edges, of single or multiple blade shaving systems. Upon exposure to water, the water-soluble shaving aid leaches from the composite onto the skin. These composites tend to release large amounts of shaving aid in the first few shaves and dramatically less shaving aid in subsequent shaves. Furthermore, extruded composites with relatively large amounts of shaving aid (up to 80% by weight) and relatively low amounts of water insoluble matrix material (as little as 20% by weight) are relatively weak and have a tendency towards mechanical failure, both in assembly and in use. Increased mechanical strength can be obtained with increased amounts of the insoluble matrix material. However, such increase reduces the releasability of the shaving aid material.

Commercial lubricating strips, especially those with high levels of polyethylene oxide lubricant like those described in U.S. Pat. No. 4,170,821 to Booth and U.S. Pat No. 5,113,585 to Rogers, tend to deteriorate after use. Leach rate varies during the course of shaving and typically about 50% of the polyethylene oxide is trapped in the strip. The selection of the polyethene oxide carrier (i.e., the non-water soluble matrix material) is limited to a carrier that has a low melting or softening temperature and is at least partially miscible with polyethene oxide. In addition, because the strip is made at a high temperature of approximately 180° C., additives such as fragrances and plasticizers are difficult to incorporate in the strips.

U.S. Pat. No. 4,872,263 to Etheredge, III, issued Oct. 10, 1989, discloses a lubricating device comprised of a porous matrix impregnated with a particular acid soap. The impregnated matrix is covered with a water insoluble perforated sheet material in an effort to prevent the lubricant from eroding too quickly and to provide a smooth "massaging" effect on the skin. These lubricating devices have not met with commercial success. These lubricating devices are expensive to manufacture due to the additional assembly required of the sheet-over-matrix design. They also tend to swell and delaminate when affixed to the razor cartridge with glue. Furthermore, the soft porous matrix does not lend itself to economical mechanical means of affixing the strip to the razor cartridge.

We have demonstrated that it is feasible to produce a two-component, controlled-release shaving device consisting of an outer surface layer with openings and an internal shaving aid-containing layer. The potential advantages of using the device are to 1) maintain a uniform surface appearance, 2) achieve near zero-order release profile (i.e. approximately constant release) of the shaving aid after 1–4 shaves, 3) minimize material degradation, 4) minimize shaving aid material trapped in the device, 5) provide a shaving aid device which is easy to manufacture and/or 6) to provide a shaving aid device which is easily integrated with a razor cartridge system. These and other objects of the present invention will be evident from the following:

SUMMARY OF THE INVENTION

In accordance with one aspect of the invention, there is provided a two-component, controlled-release skin engaging member consisting of (a) a sheath made from thermoplastic resin with openings therein and (b) a core containing a shaving aid. The skin engaging member can be in the form of a strip, a razor guard, a razor cap, a razor platform or a razor housing made (1) by coextrusion or two-color (i.e. two component) molding, or (2) by extruding or molding the surface layer and shaving aid separately and then assembling later. Potentially, the device can maintain surface appearance, achieve control-release of the shaving aid, minimize the degradation of the shaving aid, and prevent the shaving aid from being trapped in the skin engaging member. Furthermore, the addition of low-melt additives to the shaving aid becomes feasible and the compatibility between the shaving aid and the shaving aid carrier, such as polystyrene in the lubricating strip composite, becomes less critical.

BRIEF DESCRIPTION OF THE DRAWINGS

FIG. 4 is an enlarged perspective view of a skin engaging member of the present invention;

FIG. 5 is sectional view taken along the line 5—5 of FIG. 4.

DESCRIPTION OF PARTICULAR EMBODIMENTS

Figure 1:
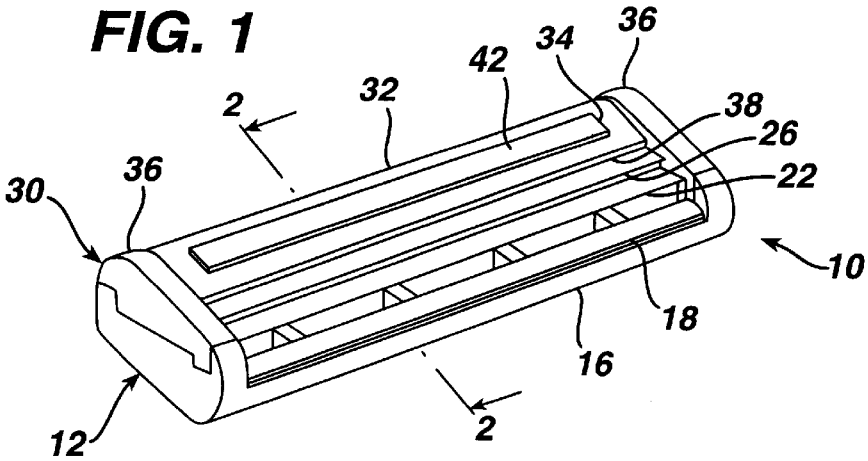
FIG. 1 is a perspective view of a razor unit in accordance with the invention.
Figure 2:
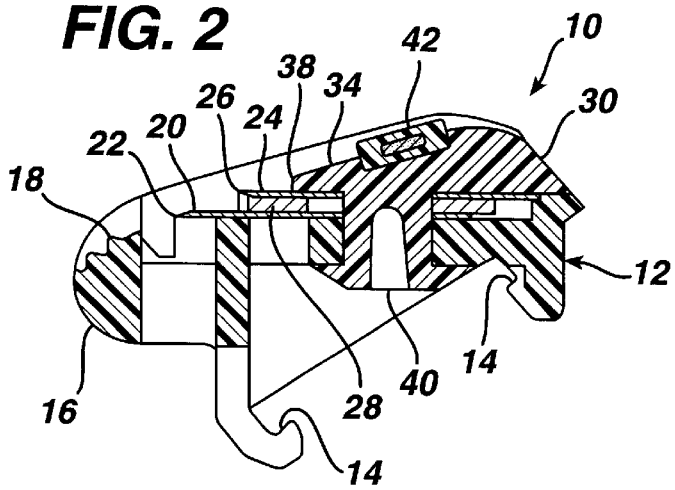
FIG. 2 is a sectional view taken along the line 2—2 of FIG. 1.

Referring to the drawings, the shaving unit 10 shown in FIGS. 1 and 2 includes base or platform member 12 molded of high impact polystyrene that includes integral coupling groove structure 14 for attachment to a razor handle and guard structure 16 that defines a transversely extending anterior skin engaging surface 18. On the upper surface of platform 12 are disposed steel leading blade 20 having a sharpened edge 22, steel following blade 24 having sharpened edge 26, and aluminum spacer member 28 that maintains blades 20 and 24 in spaced relation. Cap member 30 is molded of high impact polystyrene and has body portion 32 that defines the posterior skin engaging surface 34 that extends transversely between forwardly projecting end walls 36 and has a front edge 38 that is disposed rearwardly of blade edge 26. Integral rivet portions 40 extend downwardly from transversely extending body portion 32 and pass through holes in blades 20 and 24, spacer 28, and platform 12 to secure cap 30, blades 20, 24 and spacer 28 on platform 12. Adhesively affixed to skin engaging surface 34 is skin engaging member 42.

Figure 3:
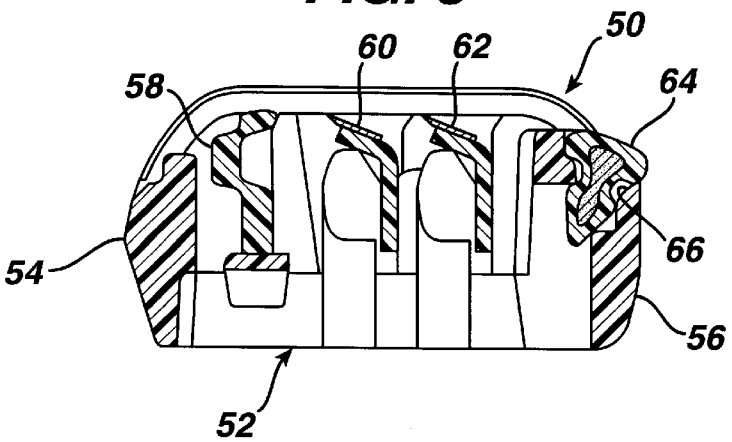
FIG. 3 is a sectional view of another razor unit in accordance with the present invention.
Figure 6:
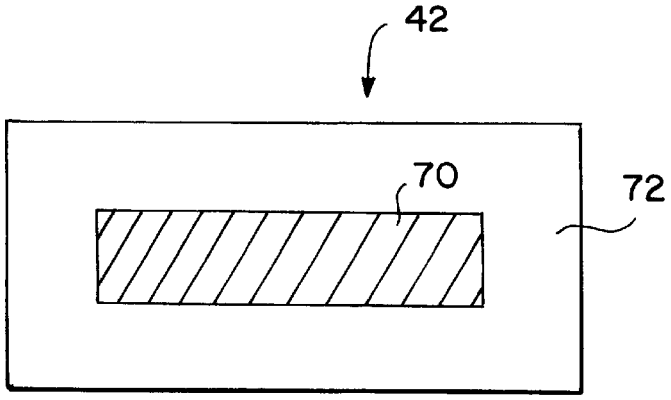
FIG. 6 is a sectional view of the skin engaging member 42 found in FIG. 2.

The shaving unit 50 shown in FIG. 3 is of the type shown in Jacobson U.S. Pat. No. 4,586,255, incorporated herein by reference, and includes body 52 with front portion 54 and rear portion 56. Resiliently secured in body 52 are guard member 58, leading blade unit 60 and trailing blade unit 62. A shaving aid composite in the form of elongated skin engaging member 64 is frictionally locked in opening 66 of rear portion 56.

FIGS. 4–6 and 8–11 generally depict variations on the present invention. As used herein, the term "core" refers to an internal portion of a skin engaging member as examined at the cross-section. The core typically runs throughout the skin engaging member along an axis. The axis need not be the central axis. The FIGS. designate the core as 70. Embodiments of the present invention have at least one core. As used herein, the term "sheath" refers to an outer coating layer(s) over the core 70. The FIGS. designate the sheath as 72.

The two-component, controlled-release skin engaging member of the present invention consists of an outer sheath which surrounds an internal core, wherein said core contains shaving aid such as water soluble polymers and additives. The skin engaging surface 74 can be an insoluble layer with built-in openings, or a soft layer such as a commercial strip (polyethylene oxide/polystyrene) which will become porous during use.

Referring again to the drawings, and in particular to FIGS. 3–5, there is shown an elongated skin engaging member 64. The member 64 has a skin engaging surface 74 and an elongated insert member 76. The insert member 76 is designed to frictionally lock in an opening 66 as shown in FIG. 3. The skin engaging member further comprises a shaving aid-containing core 70 which is surrounded by a sheath 72. The sheath includes at least one opening to release shaving aid to the skin. Preferably, the sheath includes from about 3 to about 30 holes 78, most preferably 10–15 holes, evenly distributed along the skin engaging surface 74. Hole diameters vary depending on the particular shaving aid selected: however, we have observed best results with hole diameters of from about 0.020 to about 0.040 inches. Preferably, the hole diameter is about 0.035 inches. It should be noted that the holes need not be circular in shape and that any shape hole would suffice. See for example FIGS. 7–11. The hole area along the skin engaging surface is important. Preferably, the hole area is from about 0.0005 to about 0.0250 square inches. When a high level of polyethylene oxide lubricant is utilized in the core, a hole area of about 0.0125 square inches is preferred. Many shaving aids tend to swell upon contact with water. By binding these swelling shaving aids within an insoluble matrix material, the degree of swell can be modified to prevent aesthetically unpleasant results. The most preferred hole pattern is found in FIGS. 4–5.

The shaving aid is selected from the group consisting of polyethylene oxide, polyvinyl pyrrolidone, polyacrylamide, hydroxypropyl cellulose, polyvinyl imidazoline, polyethylene glycol, poly vinyl alcohol, polyhydroxyethylmethacrylate, silicone copolymers, sucrose stearate, vitamin E, soaps, surfactants, panthenol, aloe, plasticizers, such as polyethylene glycol; beard softeners; additional lubricants, such as silicone oil, Teflon® polytetrafluoroethylene powders (manufactured by DuPont), and waxes; essential oils such as menthol, camphor, eugenol, eucalyptol, safrol and methyl salicylate; tackifiers such as Hercules Regalrez 1094 and 1126; non-volatile cooling agents, inclusion complexes of skin-soothing agents with cyclodextrins; fragrances; antipruritic/counterirritant materials; antimicrobial/keratolytic materials such as Resorcinol; anti-inflammatory agents such as Candilla wax and glycyrrhetinic acid; astringents such as zinc sulfate; surfactants such as pluronic and iconol materials; compatibilizers such as styrene-b-EO copolymers; and combinations thereof. The shaving aid(s) may release from the surface to provide improved shaving. The shaving aid(s) can be dispersed throughout the core and, additionally, the outer sheath may also contain small amounts of the shaving aid(s).

Preferably, said shaving aid is a water soluble or water miscible material; however, non-water soluble additives can also be incorporated as long as they can be carried out with a water soluble core component.

The preferred shaving aid will comprise a lubricious water-soluble polymer. Such water-soluble polymer will preferably comprise at least 50%, more preferably at least 60%, by weight of the core. The more preferred water-soluble polymers are the polyethylene oxides generally known as POLYOX (available from Union Carbide Corporation) or ALKOX (available from Meisei Chemical Works, Kyoto, Japan). These polyethylene oxides will preferably have molecular weights of about 100,000 to 6 million, most preferably about 300,000 to 5 million. The most preferred polyethylene oxide comprises a blend of about 40 to 80% of polyethylene oxide having an average molecular weight of about 5 million (e.g. POLYOX COAGULANT) and about 60 to 20% of polyethylene oxide having an average molecular weight of about 300,000 (e.g.

POLYOX WSR-N-750). The polyethylene oxide blend may also advantageously contain up to about 10% by weight of a low molecular weight (i.e. MW<10,000) polyethylene glycol such as PEG-100.

The shaving aid may also advantageously comprise a non-volatile cooling agent or an inclusion complex of a skin-soothing agent with a cyclodextrin, preferably in amounts up to about 25%, most preferably 10 to 20%, by weight of the core.

By non-volatile cooling agent is meant an agent which has a physiological cooling effect on the skin and which is appreciably less volatile than menthol. Preferably, the non-volatile cooling agent will be one which when subjected to thermogravimetric analysis (e.g. using a 951 Thermogravimetric Analyzer from Dupont with a 20° C. temperature rise per minute) will retain at least 50% of its initial weight at a temperature of 160° C., more preferably at least 80% of its initial weight at a temperature of 160° C., and most preferably at least 50% of its initial weight at a temperature of 175° C.

Suitable cooling agents which can be utilized include non-volatile menthol analogs such as menthyl lactate, menthyl ethoxyacetate, menthone glycerinacetal, 3-l-menthoxypropane-1,2-diol, ethyl l-menthyl carbonate, (1S, 3S,4R)-p-menth-8-en-3-ol, menthyl pyrrolidone carboxylate, N-substituted-p-menthane-3-carboxamides (as described in U.S. Pat. No. 4,136,163, which is incorporated herein by reference) including, for example, N-ethyl-p-menthane-3-carboxamide, acyclic carboxamides of the formula

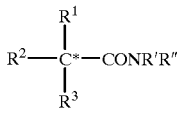

where R' and R", when taken separately, are each hydrogen, $C_1$–$C_5$ alkyl or $C_1$–$C_8$ hydroxyalkyl and provide a total of no more than 8 carbon atoms, with the proviso that when R' is hydrogen R" may also be alkylcarboxyalkyl of up to 6 carbon atoms; R' and R", when taken together, represent an alkylene group of up to 6 carbon atoms thereby forming a nitrogen heterocycle, the alkylene chain being optionally interrupted by oxygen; $R^1$ is hydrogen or $C_1$–$C_5$ alkyl; and $R^2$ and $R^3$ are each $C_1$–$C_5$ alkyl (such acyclic carboxamides being described in U.S. Pat. No. 4,153,679, which is incorporated herein by reference) including, for example, N,2,3-trimethyl-2-isopropylbutanamide, and ketal coolants (as described in WO 93/23005, which is incorporated herein by reference) including, for example, l-menthon-/d-isomenthon glycerin ketal.

Suitable skin-soothing agents which can be utilized in the cyclodextrin inclusion complex include menthol, camphor, eugenol, eucalyptol, safrol, methyl salicylate, and the aforedescribed menthol analogs. Any suitable cyclodextrin may be utilized to form the inclusion complex including alpha-cyclodextrin, beta-cyclodextrin, gamma-cyclodextrin and modified cyclodextrins such as hydroxypropyl-beta-cyclodextrin, methyl-beta-cyclodextrin., and acetyl-beta-cyclodextrin. The preferred cyclodextrins are beta-cyclodextrin and gamma-cyclodextrin.

When the shaving aid comprises a cyclodextrin inclusion complex, the core may also advantageously comprise up to about 10%, preferably about 2 to 7%, by weight of a displacing agent which displaces the skin-soothing agent from the inclusion complex upon contact with water, thereby enhancing the release of the skin-soothing agent from the core material during use. The displacing agent is a material which is capable of forming a more stable complex with the cyclodextrin than the complex formed with the skin-soothing agent and, thus, displaces the skin-soothing agent from the complex when the shaving aid is contacted with water. Suitable displacing agents include surfactants, benzoic acids, and certain amines (e.g. urea).

Further details with respect to the aforementioned cooling agents, cyclodextrin inclusion complexes and displacing agents may be found in the following copending U.S. patent applications, the disclosures of which are incorporated herein by reference: Ser. No. 08/496,860 entitled Shaving Aid Composite With An Inclusion Complex Of A Skin-Soothing Agent And A Cyclodextrin, filed on Jun. 30, 1995; and Ser. No. 08/497,193 entitled Shaving Aid Composite With A Non-Volatile Cooling Agent, filed on Jun. 30, 1995.

The core includes from about 0% to about 50% by weight, preferably from 0% to about 20%, of a water-insoluble matrix and from about 50% to about 100% by weight, preferably from about 80% to about 100%, of the shaving aid. Suitable water-insoluble polymers for the matrix include, for example, nylon, ethylene vinyl acetate (EVA), polyethylene, polypropylene, polyurethane, polystyrene, polystyrene-butadiene, polyacetal, polyphenol/polystyrene blends(such as NOREL brand polymer), and combinations thereof.

The sheath must have sufficient mechanical strength and rigidity to provide adequate mechanical strength to the entire skin engaging member, both as initially produced and after a significant amount of water soluble material has been leached out of the skin engaging member. Preferably the sheath will comprise at least 35%, most preferably at least 40%, by weight of a water-insoluble polymer, particularly a thermoplastic resin. Thermoplastic resins suitable for use in the sheath include polystyrene, high impact polystyrene (polystyrene-butadiene), polypropylene, filled polypropylene, polyethylene, nylon ethylene vinyl acetate, and blends such as 70% nylon/30% polyethylene oxide, 60% polystyrene/40% polyethylene oxide. The preferred resins are high impact polystyrene, polystyrene, ethylene vinyl acetate (EVA) and combinations thereof. In addition to the water-insoluble polymer, the sheath may also comprise some water-soluble polymer, such as polyethylene oxide, but generally no more than about 65% by weight, preferably less than 60% by weight, in order to maintain the structural integrity of the sheath. Optionally, the sheath can include additives such as lubricants or plasticizers, fillers such as $CaCO_3$, and colorants such as $TiO_2$.

In one embodiment of the present invention a wear indicating effect is produced when the sheath and the core material are made of disparately colored materials (e.g. white colored sheath and blue colored core). The core leaches out of the skin engaging member through use. With sufficient use, a colored region within the core leaches out. By examining the release holes along the skin engaging surface, the user is provided with an indication that the shaving unit and/or skin engaging surface have reached their effective life. In a preferred embodiment, the core consists of polyethylene oxide/polystyrene blend which is colored with Indigotine, FD&C #2 dye and the sheath consists of nylon and/or polystyrene which has been colored white.

According to the present invention, the skin engaging members may be affixed by adhesive such as Loctite Super Bonder 499, by mechanical locking mechanism, by thermal welds or by a combination thereof.

The skin engaging member can be a strip made by two-color (two-component) molding or coextruding, or by extruding or molding the surface layer and the shaving aids separately and then assembling later. The skin engaging member can then be glued or snapped onto a razor cartridge. The skin engaging member can also be a razor cap, platform, or housing made by two-color molding. For example, 1) a surface with holes can be made by molding or two-color molding, and 2) a surface with channels can be made by molding. Extrusion and coextrusion processes are preferred as they require less capital and skilled labor. When the skin engaging member is coextruded, holes must be made in the skin engaging surface. The holes are placed in the sheath by any of the following processes: drilling, laser, water jet, embossing or puncturing. The core and the sheath should be processed at different barrel temperatures to minimize material degradation. To easily incorporate functional additives including liquids and powders into the core, a twin-screw extruder should be considered as an alternative to the single-screw extruder used in the extrusion and coextrusion processes. Optimally, the sheath will have a hard to moderately hard surface.

The preferred skin engaging member is produced by a coextrusion process whereby a sheath is present on at least the skin engaging surface 74. The nature and relative portions of the sheath and core polymeric materials are such that the skin engaging member has adequate mechanical strength, both as initially produced and after a significant amount of water soluble material has been leached out, the quantity of the water-soluble material being sufficient to provide effective shaving assistance, such as lubrication, for the entire expected life of the blade or blades. The function of the sheath is not only to provide additional rigidity but to meter the shaving aid. In conventional skin engaging members, such as those described in U.S. Pat. Nos. 5,063,667; 5,095,619; and 5,113,585, a significant amount of shaving aid is trapped within the insoluble matrix. By increasing the shaving aid in the core, diffusion is increased and more efficient delivery is achieved. Furthermore, if an insoluble matrix is added to the core, it also provides some additional mechanical strength.

Figure 7:
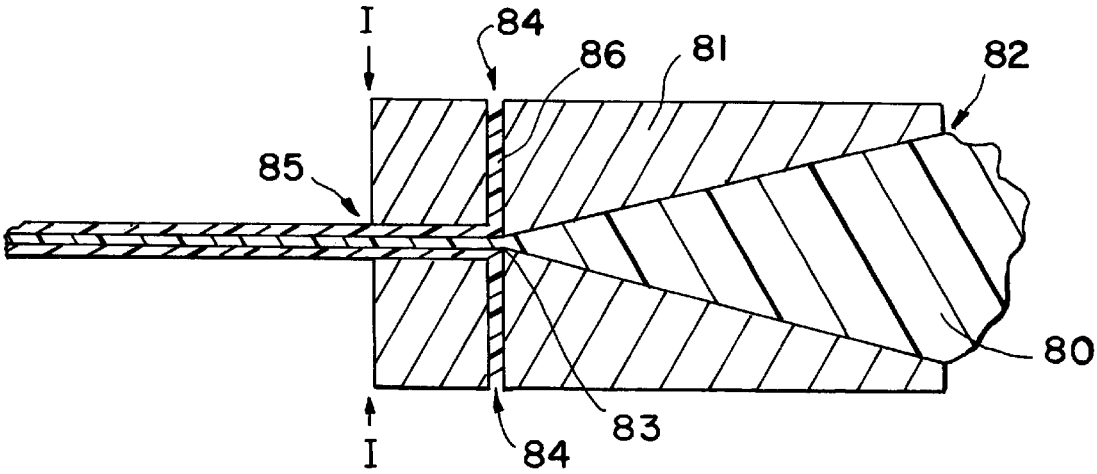
FIG. 7 is a schematic cross-section diagram of an extrusion die suitable for manufacturing the skin engaging member of FIG. 3.
Figure 9:
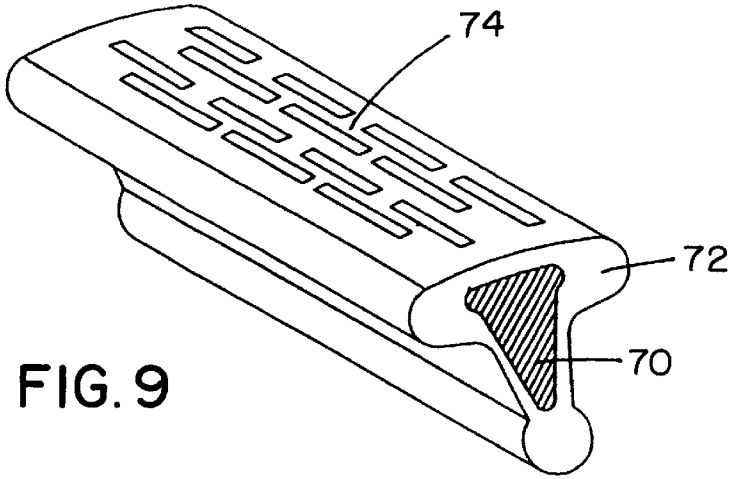
FIGS. 8–11 are enlarged perspective views of alternate skin engaging members according to the present invention.
Figure 8:
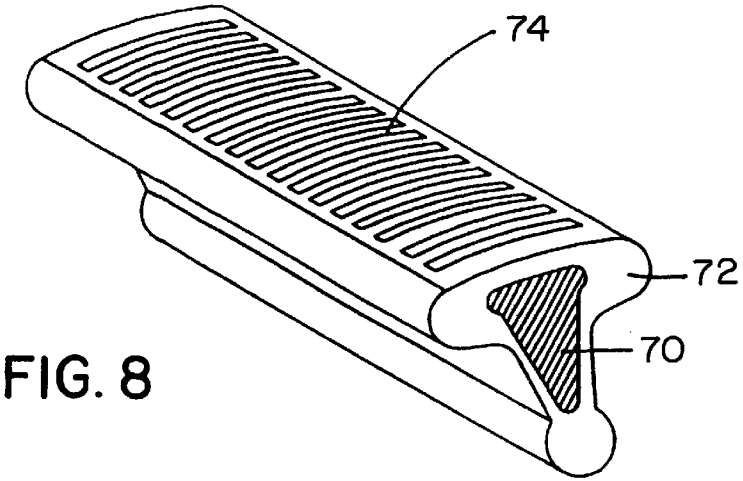
Figure 11:
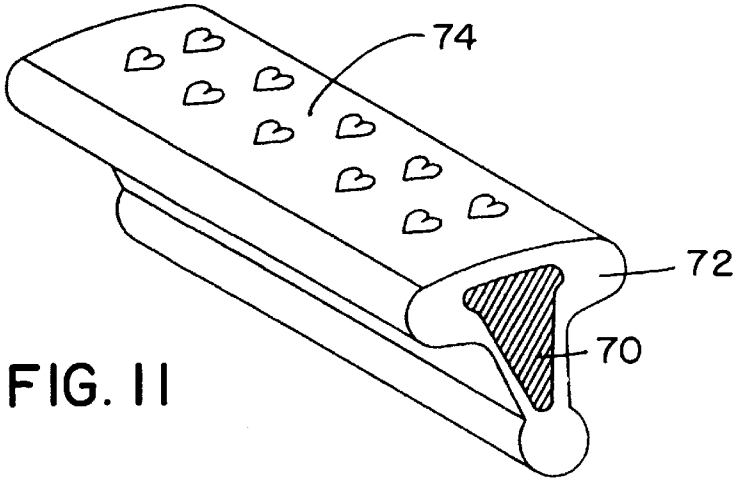
Figure 10:
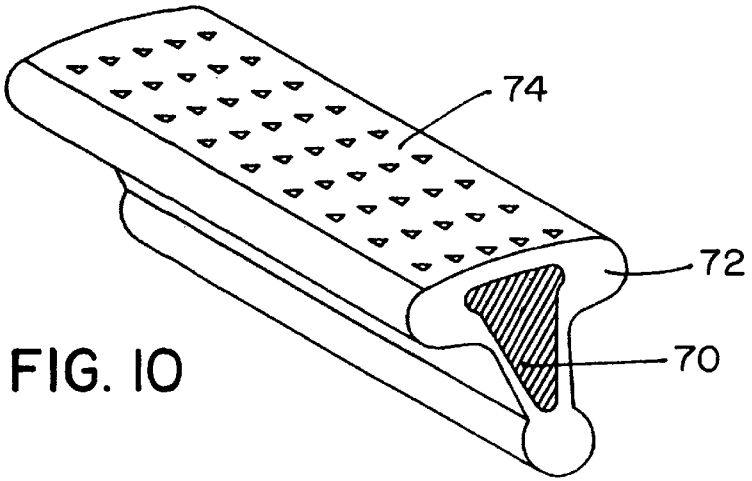

FIG. 7 is a schematic cross section diagram down the length of a two-component extruder (or coextruder) suitable for manufacturing the skin engaging member of the present invention. Core material 80 is fed into the intrusion die 81 by an extrusion screw, hot melt or other suitable means. In the core inlet port 82 the tight core orifice 83 encounters the sheath material 86, which has been fed into sheath inlet port 84, wherein the core becomes encapsulated by the sheath material when viewed in a transverse cross section to the flow of the die material. The encapsulated core then proceeds to the die outlet 85 wherein the continuous skin engaging members can be cured and/or drawn down to provide the appropriate dimensions. For general discussion of coextrusion technology see Levi, *Plastics Extrusion Technology Handbook*, Industrial Press Inc., pages 168–188 (1981), incorporated herein by reference. After the continuous skin engaging members are produced, the strand is sent for further processing where it is typically drawn down to the correct size and cut to length suitable for implant into the body of a razor blade cartridge. This cutting can be achieved by knife edge cutting, lasers or water jet. The skin engaging surfaces of the present invention typically are rectangular in shape with a width of from about 0.05 inches to about 0.1 inches and a length of about 1.2 inches.

The two-component extruder allows the core material to be processed at a relatively low temperature to reduce material degradation. For example, polyethylene oxide can be processed at a temperature lower than that required by conventional strips, i.e. polyethyethylene oxide in insoluble matrix lubricating strips. Shaving aid can be made from water soluble polymers such as polyethylene oxide, polyethylene glycol, and polyvinyl alcohol, etc. Additives such as perfume, moisturizers, Vitamin E, and plasticizers etc. can easily be added to the shaving aid. Additives can also be water-insoluble materials as long as they can be carried out through the surface openings. The core containing shaving aid can be molded or extruded, although the extrusion process is preferred.

Leach rates of the shaving aids depend on the thickness of the surface, the number and the shape of the openings, and the surface structures (porous or non-porous). The surface layer can also be made to be removable so that the shaving aids can be added to the device during use.

Applicant considers equivalent embodiments to be part of the present invention. For example, non-rectangular skin engaging surface areas may be utilized (such as ovals) and non-flat surface patterns could be utilized. These and other equivalent embodiments are also contemplated by the present invention. The present invention and the manner of making and using the same should be evident from the following examples:

EXAMPLES 1–8

Core containing shaving aid such as those found in Table 1 are co-extruded into a device with a cross-section as in FIG. 7 at approximately the temperatures found in the table. Typical finished width is ⅛ of an inch after a draw down of less than 2%. These devices require no additional assembly. The coextrusion line includes two ¾" HBI Systems 90 extruders (mfg. by Haake), and a coextrusion die. The sheath or outer layer of the coextruded skin engaging member was made from a mixture at barrel temperature as shown and the core containing shaving aid was made from the material shown. The hole pattern is cut with a 0.030 inch diameter drill in the pattern of FIG. 4. The finished strips are cut 1.25 inches long with a knife edge cutter resulting in 13 holes per strip.

Typical Processing Conditions

| | Temperature (C.): | | | | |
|---|---|---|---|---|---|
| zone | 1 | 2 | 3 | 4 | 5 |
| Extruder 1 (inner) | 130 | 180 | 180 | 180 | 180 |
| Extruder 2 (outer) | 150 | 180 | 180 | 180 | 180 |

Rotor Speed:

| | |
|---|---|
| Extruder 1 | 42 RPM |
| Extruder 2 | 48 RPM |
| Line Speed: | approximately 15 to 20 ft/min |

TABLE 1

| | | | |
|---|---|---|---|
| 1. | Outer layer | 50% | high impact polystyrene (Mobil 4324) |
| | | 40% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 88% | polyethylene oxide blend:. |

TABLE 1-continued

| | | | |
|---|---|---|---|
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 2% | Green colorant |
| 2. | Outer | 40% | high impact polystyrene (Mobil 4324) |
| | layer | 50% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 88% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 2% | Green colorant |
| 3. | Outer | 37% | high impact polystyrene (Mobil 4324) |
| | layer | 53% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 90% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| 4. | Outer | 35% | high impact polystyrene (Mobil 4324) |
| | layer | 50% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 8% | Polyethylene Glycol MW = 4500 (Dow 4500) |
| | | 7% | Salsorb 88, cross-linked sodium polyacrylates |
| | | | (Allied) |
| | Inner | 88% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 2% | Green colorant |
| 5. | Outer | 33% | high impact polystyrene (Mobil 4324) |
| | layer | 56% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 7% | Polyethylene Glycol MW = 4500 (Dow 4500) |
| | | 4% | Salsorb 88, cross-linked sodium polyacrylates |
| | | | (Allied) |
| | Inner | 90% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| 6. | Outer | 40% | high impact polystyrene (Mobil 4324) |
| | layer | 50% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 73% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 15% | Menthone glycerinacetal (Frescolat MGA) |
| | | 2% | Green colorant |
| 7. | Outer | 40% | high impact polystyrene (Mobil 4324) |
| | layer | 50% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 78% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |

TABLE 1-continued

| | | | |
|---|---|---|---|
| | | 10% | N-ethyl-p-menthane-3-carboxamide (WS-3) |
| | | 2% | Green colorant |
| 8. | Outer | 40% | high impact polystyrene (Mobil 4324) |
| | layer | 50% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | Inner | 73% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 15% | γ-cyclodextrin/menthol inclusion complex |
| | | 2% | Green colorant |

EXAMPLES 9 & 10

Control

A conventional lubricating strip, similar in external dimensions to FIGS. 4–5, was prepared according to the general method described in U.S. Pat. No. 5,113,585 to Rogers. The formulation for the strip is as follows:

9.

33.5% high impact polystyrene (Mobil 4324)

55% polyethylene oxide blend:

3 parts POLYOX WSR Coagulant (MW 5,000,000)

2 part POLYOX WSR N-750 (MW 300,000)

(Both mfg by Union Carbide Corp. Danbury, Conn.)

10% Polyethylene Glycol MW=4500 (Dow 4500)

1.5% Misc. additives and colorants

Present Invention

A lubricating strip according to the present invention was prepared according to the general method described in Examples 1–8. The formulation for the strip is as follows:

| | | | |
|---|---|---|---|
| 10. | Outer | 33.5% | high impact polystyrene (Mobil 4324) |
| | layer | 55% | polyethylene oxide blend: |
| | | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 10% | Polyethylene Glycol MW = 4500 (Dow 4500) |
| | | 1.5% | Misc. additives and colorants |
| | Inner | 85% | polyethylene oxide blend: |
| | layer | | 3 parts POLYOX WSR Coagulant (MW 5,000,000) |
| | | | 2 part POLYOX WSR N-750 (MW 300,000) |
| | | | (Both mfg by Union Carbide Corp. Danbury, CT) |
| | | 5% | Polyvinyl alcohol |
| | | 8% | Polyethylene Glycol MW = 4500 (Dow 4500) |
| | | 2% | Misc. additives and colorants |

Figure 12:
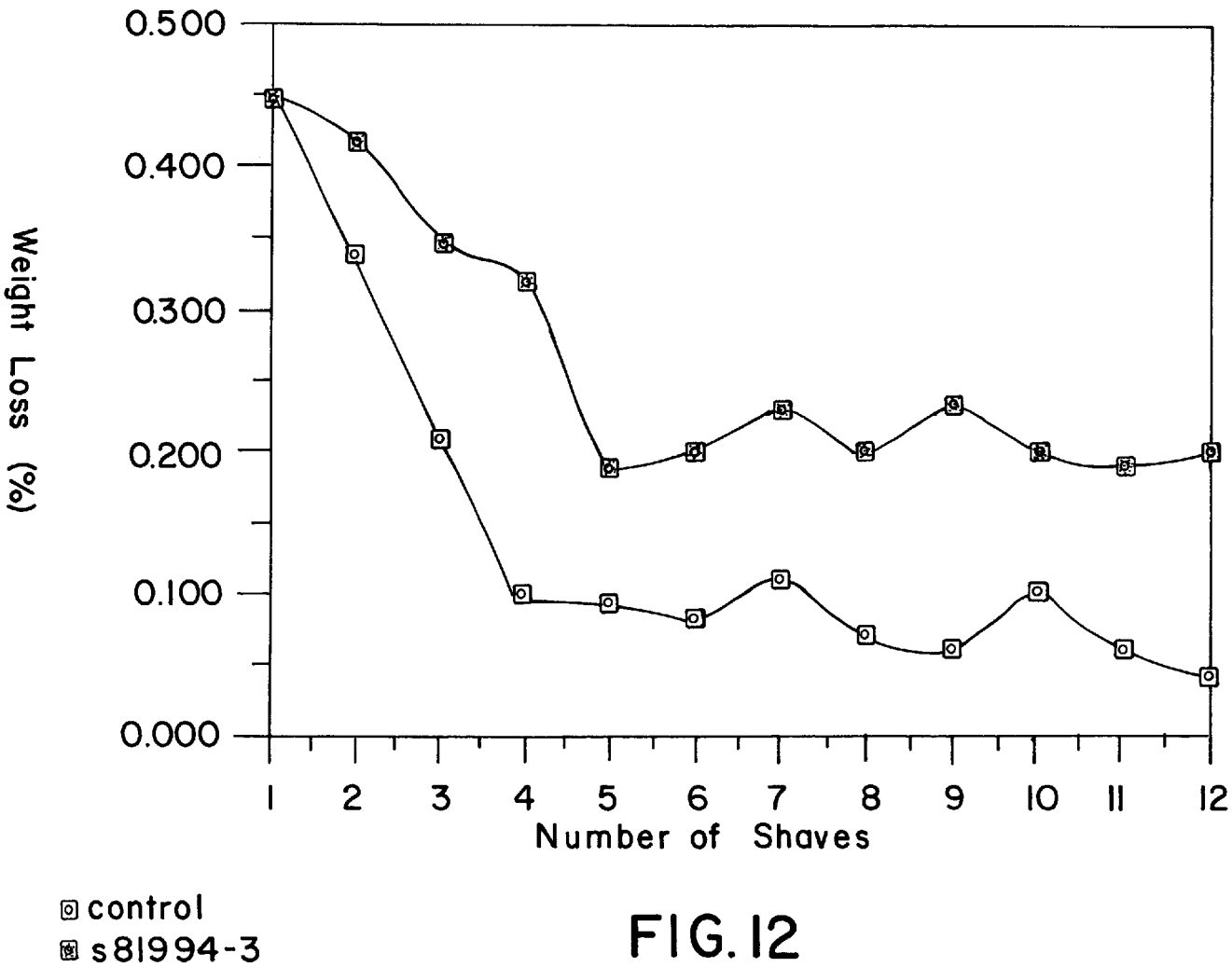
FIG. 12 is a plot of shaving aid release versus the number of theoretical shaves, comparing a conventional lubricating strip with a lubricating strip according to the present invention.

The weight loss (dry) of the cartridge was monitored over the course of several simulated in vitro shave tests. We believe that these in vitro tests correlate well with average in vivo shaves. The results are plotted as FIG. 12. The plot shows that in Example 10 therapeutic levels of lubricant continue to be delivered in a near zero-order release profile (i.e. approximately constant release) after the fourth shave. However, very low levels are provided in Example 9 (control).

What is claimed is:

1. A razor cartridge comprising a blade and a skin engaging member affixed adjacent said blade, said skin engaging member comprising, prior to and after assembly into said razor cartridge, an elongated solid polymeric sheath comprising a water insoluble polymer, said sheath having a skin engaging surface extending along an outer surface thereof, and an internal solid polymeric core integrally formed with said sheath and extending axially throughout and surrounded by said sheath, said core containing 50% to 100% by weight of a solid shaving aid, said solid shaving aid comprising a water soluble polymer, wherein said sheath has at least one opening in said skin engaging surface through which said shaving aid is released during shaving.

2. The razor cartridge of claim 1 wherein said sheath comprises at least 35% by weight water insoluble polymer and said core comprises at least 60% by weight water soluble polymer.

3. The razor cartridge of claim 2 wherein said water insoluble polymer comprises a polymer selected from the group consisting of polystyrene, high impact polystyrene, polypropylene, filled polypropylene, polyethylene, nylon, and ethylene vinyl acetate.

4. The razor cartridge of claim 3 wherein said core additionally comprises about 0 to 20% by weight of water insoluble matrix.

5. The razor cartridge of claim 4 wherein said water insoluble matrix comprises a polymer selected from the group consisting of nylon, ethylene vinyl acetate, polyethylene, polypropylene, polyurethane, polystyrene, polystyrene-butadiene, polyacetal, and polyphenol/polystyrene blends.

6. The razor cartridge of claim 5 wherein said sheath additionally comprises less than 60% by weight of water soluble polymer.

7. The razor cartridge of claim 1, 2, 4, 5, or 6 wherein said water soluble polymer comprises polyethylene oxide.

8. The razor cartridge of claim 3 wherein said water soluble polymer comprises polyethylene oxide.

9. The razor cartridge of claim 3 or 8 wherein said sheath and said core are disparately colored.

10. The razor cartridge of claim 8 wherein said at least one opening comprises a plurality of openings with a combined total area of about 0.0005 to about 0.0250 square inches.

11. The razor cartridge of claim 8 wherein said at least one opening comprises about 3 to about 30 holes each having a diameter of about 0.020 to about 0.040 inches.

12. The razor cartridge of claim 8 wherein said solid shaving aid includes non-volatile cooling agent or an inclusion complex of a skin-soothing agent with a cyclodextrin.

13. The razor cartridge of claim 12 wherein said non-volatile cooling agent is selected from menthyl lactate, menthyl ethoxyacetate, menthone glycerinacetal, 3-l-menthoxypropane-1,2-diol, ethyl l-menthyl carbonate, (1S, 3S,4R)-p-menth-8en-3-ol, menthyl pyrrolidone carboxylate, N-ethyl-p-menthane-3-carboxamide, and N,2,3-trimethyl-2-isopropylbutanamide and wherein said skin-soothing agent is selected from menthol, camphor, eugenol, eucalyptol, safrol, methyl salicylate and the aforesaid non-volatile cooling agents.

14. The razor cartridge of claim 1 wherein said solid shaving aid includes a material selected from the group consisting of polyethylene oxide, polyvinyl pyrrolidone, polyacrylamide, hydroxypropyl cellulose, polyvinyl imidazoline, polyethylene glycol, polyvinyl alcohol, polyhydroxyethyl-methacrylate, silicone copolymers, sucrose stearate, vitamin E, soaps, surfactants, panthenol, aloe, plasticizers, beard softeners, lubricants, polytetrafluoroethylene powders, waxes, menthol, eugenol, eucalyptol, safrol, methyl salicylate, tackifiers, non-volatile cooling agents, inclusion complexes of skin-soothing agents with cyclodextrins, fragrances, antipruritic/counterirritant materials, antimicrobialvkeratolytic materials, anti-inflammaltory agents, astringents, and compatibilizers.

* * * * *